US005638976A

United States Patent [19]

Arnold

[11] Patent Number: 5,638,976

[45] Date of Patent: Jun. 17, 1997

[54] CONTAINER WITH ROTATABLE LOCKING LID

[76] Inventor: Bruce Douglas Arnold, 1035 Valencia Rd., Key Largo, Fla. 33037

[21] Appl. No.: 558,808

[22] Filed: Nov. 15, 1995

[51] Int. Cl.[6] ..... B65D 41/06

[52] U.S. Cl. ..... 220/298; 220/212.5; 220/293; 215/330; 215/331; 215/340

[58] Field of Search ..... 220/293, 294, 220/298, 299, 301, 302, 212.5; 215/321, 330, 331, 340

[56] References Cited

U.S. PATENT DOCUMENTS

| | | | |
|---|---|---|---|
| 1,528,566 | 3/1925 | Podel | 215/340 X |
| 1,741,108 | 12/1929 | Gruver | 215/330 |
| 1,948,953 | 2/1934 | Wayer et al. | 220/298 X |
| 3,233,727 | 2/1966 | Wilson | 215/340 X |
| 4,027,777 | 6/1977 | Blanke et al. | 220/298 X |
| 4,032,036 | 6/1977 | Sycle, Jr. | 220/301 X |
| 4,203,686 | 5/1980 | Bowman | 220/301 X |

FOREIGN PATENT DOCUMENTS

| | | | |
|---|---|---|---|
| 135109 | 4/1979 | Germany | 220/298 |

*Primary Examiner*—Stephen K. Cronin
*Attorney, Agent, or Firm*—Robert M. Schwartz; Edward I. Mates

[57] ABSTRACT

A lid is rotatable relative to the upper end of a container. The container carries at least two circumferentially spaced ribs tapered longitudinally in thickness from a relatively narrow rib end to a relatively wide rib end in a given circumferential direction. The lid may have an equal number of lugs, each defining a tapered passageway having a relatively wide end sufficiently large to provide clearance around the relatively narrow end of the corresponding rib and to permit rotation of increments of successively smaller cross section past increments of successively larger cross section of the ribs until the lugs and ribs jam against each other radially, axially and circumferentially to provide a relatively rigid structure where the ribs and lugs overlap. At least three exterior walls of the ribs simultaneously engage three interior walls of the lugs when the ribs and the lugs simultaneously engage. At least one of the jamming surfaces and an engaged surface is in an oblique plane. Optionally, cooperating protrusions and indentations can be provided on the lugs and the ribs to further secure said lugs and ribs where they jam.

11 Claims, 6 Drawing Sheets

CONTAINER WITH ROTATABLE LOCKING LID

BACKGROUND OF THE INVENTION

1. Field of the Invention

This invention relates to a container such as a garbage pail and a cover for the container constructed and arranged to incorporate a variety of features that facilitate the locking and unlocking of the cover over the container using a simple construction that makes it relatively easy to operate and to fabricate component parts of rigid construction that reduces the likelihood of distorting the component parts during use.

2. Description of the Related Art

Conventional garbage pails are fabricated from relatively thin material. Such containers and their lids are not very rigid usually, and tend to become distorted after prolonged use. Covers which depend on a frictional lock between the lid and the container often become so distorted or worn that they lose their locking function completely. Exposure to ultraviolet radiation and general aging cause fatigue in plastics that leads to failure.

It becomes annoying to use covers that are distorted, being either too loose or too tight. If too loose, the lid cannot be locked onto its container and animals can readily open the container to strew garbage awaiting collection. If too tight or complicated, sanitation companies removing garbage from residential-type garbage cans find it time-consuming to remove the lid. If one of the cooperating members loses its shape, or if its locking element breaks or wears off, animals get ready access to the contents which may lead to unsanitary, unhealthy and/or unsafe conditions, particularly in the vicinity of an open can.

Various devices and measures have been suggested to overcome the aforesaid problems. These suggested solutions have included complicating the structure of the container and/or lid by adding attachment means such as springs, ropes, or chains for attachment to the lid to secure the lid to the can even when the latter is open. These additional parts increase the chance of fatigue, which leads to breakage of the additional parts. Keyhole slots, which have also been suggested, are not practical for use with thin gauge lids or containers, because forming keyholes in thin lids or containers may distort and/or weaken the lids or containers.

Recently, this art developed an open top container having a plurality of circumferentially spaced curved slots near the top of the pail constructed and arranged to receive a plurality of small slot-engaging nodules extending downwardly and inwardly from a rim for the cover. In order to cover the container, it is necessary that each nodule engages a corresponding curved slot in such a manner that the lid fits precisely over the container in exact alignment therewith. Slotting the container near its upper end weakens the structure locally, thus increasing the likelihood of distortion and increasing the time needed to align the cover to an exact orientation around the circumference of the container to insure a close fit between the lid and the container. Such a structure is shown in U.S. Pat. No. 4,473,170 to Ciancimino.

Other patents discovered during a novelty search include U.S. Pat. No. 1,369,646 (Fuller); U.S. Pat. No. 1,634,569 (Bray); U.S. Pat. No. 1,841,882 (DeFrancisci); U.S. Pat. No. 1,948,953 (Wayer); U.S. Pat. No. 2,148,169 (Merolle); U.S. Pat. No. 3,854,582 (Martinelli); U.S. Pat. No. 3,888,383 (Rowlands); U.S. Pat. No. 4,027,777 (Blanke); U.S. Pat. No. 4,501,376 (Bushby); U.S. Pat. No. 4,723,686 (Penisi); and U.S. Pat. No. 5,004,114 (Terbrusch). None of these prior art patents anticipate the novel combination of structural elements found in the embodiments of this invention to be described herein.

SUMMARY OF THE INVENTION

The present invention provides a container and locking lid assembly that is structurally reinforced in circumferentially spaced portions of the upper end of the container and around corresponding circumferentially spaced portions of the perimeter of the lid. To be more specific, at least two locking ribs of essentially equal circumferential length extend from a narrow circumferential end to a wide circumferential end. Each rib also extends essentially radially outward from the upper edge portion of the container to reinforce the latter. The ribs are circumferentially spaced from one another a distance sufficient for the container to engage the lid and to receive corresponding spaced lugs extending from the rim of the lid. Each lug defines an essentially circumferential passage extending from a larger passage opening to a smaller passage opening.

To lock the container with one hand quickly and easily, the lid is simply oriented so that each of its lugs is aligned with a different space between adjacent of said locking ribs and lowered axially over the circumferentially spaced spaces until the locking ribs are in position to enter the corresponding passages provided between the spaced lugs. The locking ribs are tapered in thickness circumferentially, radially and axially of the container and the passages defined by relatively thick walls of the spaced lugs are likewise tapered in complementary directions circumferentially, radially and axially.

When the lid is rotated about the axis of the container, the wider and thicker opening of the passage defined by the corresponding lug moves circumferentially past the thinner and narrower end of the corresponding locking rib until the passage is jammed around the locking rib along a sufficiently thick portion of the latter. Rotating the lid in the opposite direction disengages the ribs and lugs, realigning the lugs with the spaces between the circumferentially adjacent locking ribs to enable one to open the container and remove its contents readily.

When the lid is rotated in the direction in which the lid is jammed against the container, the ribs and lugs are in direct surface-to-surface contact with one another. No gasket of the type found in the prior art is included in the article of this invention as is inherent from an inspection of the drawings originally filed.

The thickness of the locking ribs and of the lugs is sufficiently greater than that of the rest of the container and of its lid, so that the tendency of the container and the lid to distort is reduced when the lugs overlap the locking ribs. While no additional attachment means between the container and the lid is necessary because the thickness of the inter-engaging locking ribs and lugs is sufficient to avoid distortion which inhibits a tendency for the container and lid to distort out of shape, this invention may include an optional feature of providing one or more cooperating protrusions and indentations at a corresponding end of each rib and lug that inter-engage with each other when the locking ribs and the container lugs are in positions where they are fully engaged by jamming.

The details of this invention will be understood better in the light of a description of a preferred embodiment and optional variations that follows:

DESCRIPTION OF THE DRAWINGS

In the drawings that form part of the description of a specific embodiment and where like reference numbers refer to like structural elements.

DESCRIPTION OF THE PREFERRED EMBODIMENTS

Figure 14:
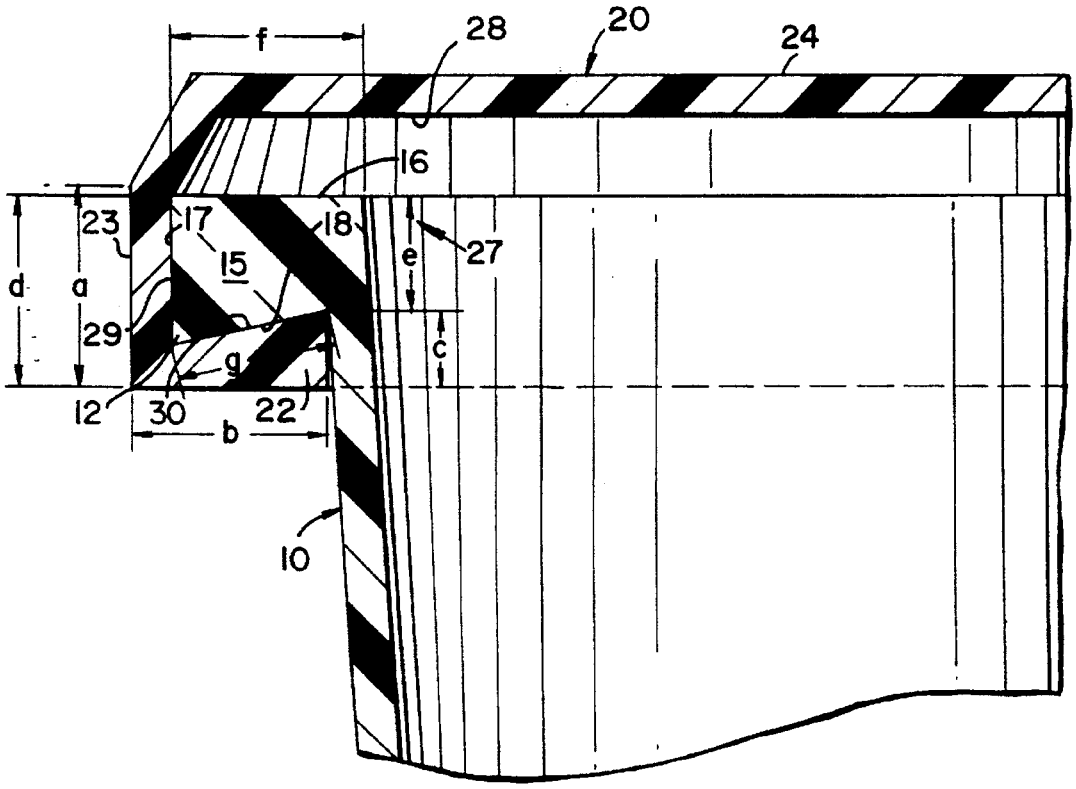
FIG. 14 is an enlarged fragmentary sectional view of a rib and a lug member where the largest cross sectional size of the rib is at the largest cross sectional size of a lug passage and the lug member is at its smallest axial size.
Figure 15:
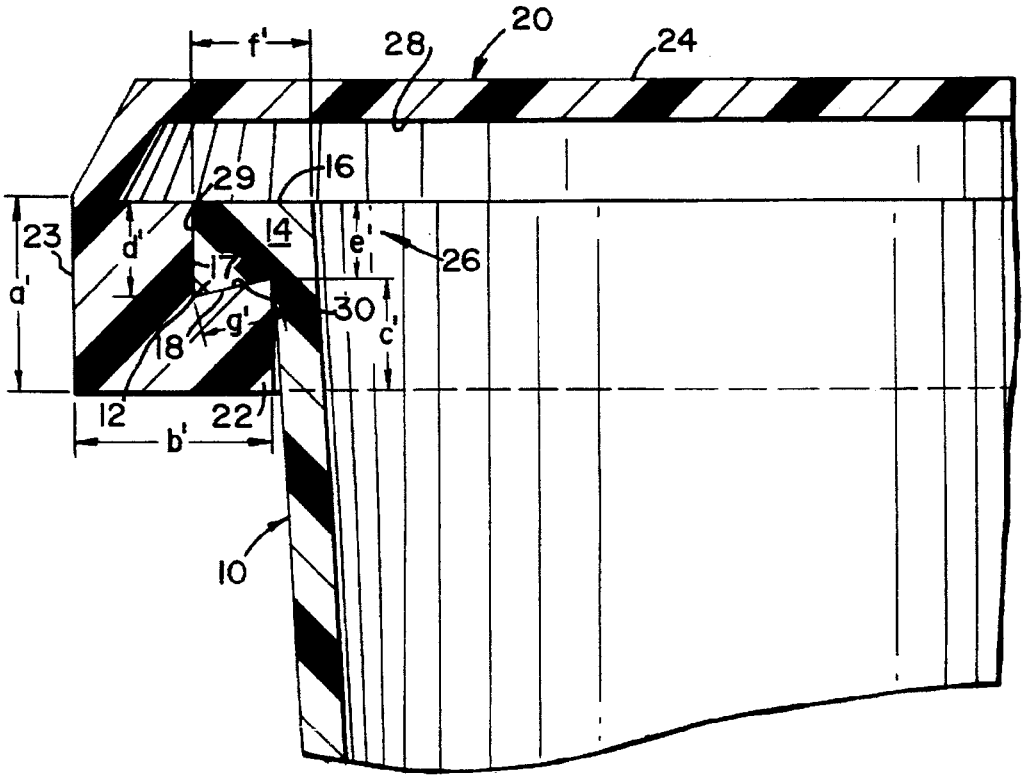
FIG. 15 is an enlarged fragmentary sectional view of a rib and lug member where the smallest cross sectional size of the rib is at the smallest cross sectional size of the lug passage, and the lug member is at its largest axial size.

The drawings show a plastic container (10), which is preferably integrally molded of unitary construction with a closed body and an open top (11) of circumferential shape. A plurality of circumferentially spaced locking ribs (12) are disposed around the rim of the open top (11). A circumferential space (13) separates circumferentially adjacent locking ribs (12). Each locking rib (12) is tapered in thickness circumferentially, radially and axially in its clockwise direction from a relatively thin cross-section at its counter clockwise end (14) to a relatively thick cross-section at its clockwise end (15). While it is not necessary to copy the exact dimensions of the embodiment to be described, a typical plastic container having a thickness on the order of ⅛ inch and a 24 inch diameter has two or more circumferentially spaced locking ribs (12) extending radially outward of the outer peripheral surface of container (10). Referring to FIGS. 14 and 15, said ribs (12) extend a radial distance designated as f' at a relatively thin end (14) tapering outwardly gradually to a radial width designated as f at a relatively thick end (15). At its counter-clockwise end (14), each locking rib (12) has an outer axial thickness that tapers from a lesser axial distance d' at its relatively thin end (14) to a greater axial distance d at its relatively thick end (15).

The replaceable lid (20) for container (10) is provided with a handle (21), two or more lugs (22) that extend radially inwardly from the lower axial end of an axially extending lid rim (23). Each lug (22) has an axial dimension designated as a shorter distance c at the small end of lug (22) and a longer distance c' at the large end of lug (22) and is constructed and arranged for each lug (22) to face each of the circumferential spaces (13) when the lid (20) is oriented for application or removal relative to container (10). The lid rim (23) extends axially downward from a cover plate or web (24) for the lid (20) to form an axial wall supporting lug (22), see FIGS. 14 and 15. Each lug (22) extends radially inward from lid rim (23) forming a lug member defined by lug (22), lid rim (23) and web (24) that provides a circumferential passage (25) for receiving each rib (12). Passage (25) tapers in a circumferential direction from a small cross section opening (26) and gradually widens circumferentially, radially and axially to a larger cross sectional opening (27).

Figure 2:
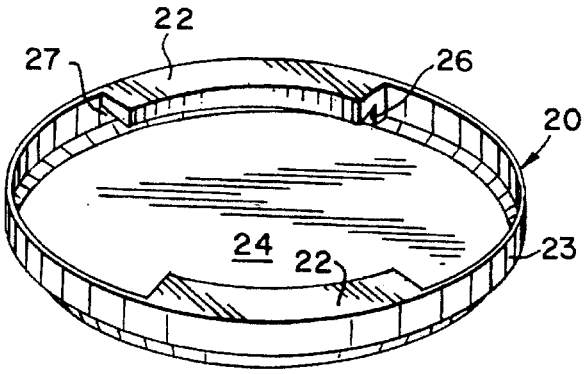
FIG. 2 is a bottom perspective view of a lid with two circumferentially spaced interior lugs complementary to the ribs of the container of FIG. 1.
Figure 9:
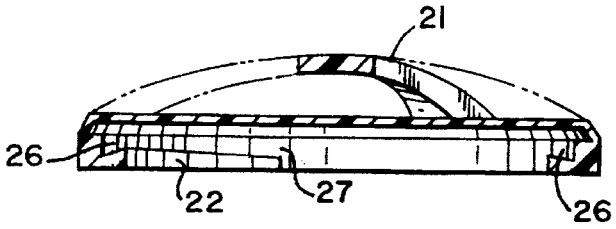
FIG. 9 is a horizontal section of the lid of FIGS. 2 and 3 taken along line 9—9 of FIG. 3.
Figure 1:
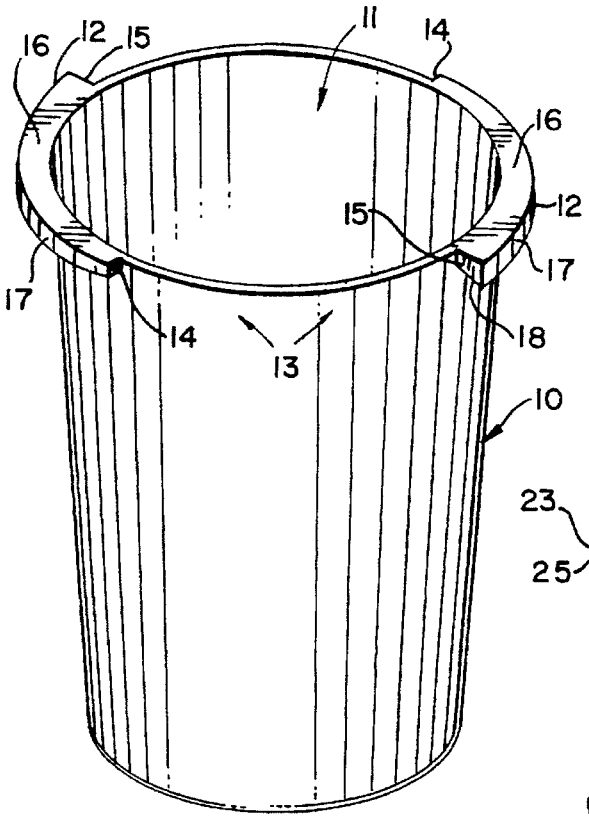
FIG. 1 is a top perspective view of an open-top container with two circumferentially spaced external ribs at its top rim.
Figure 10:
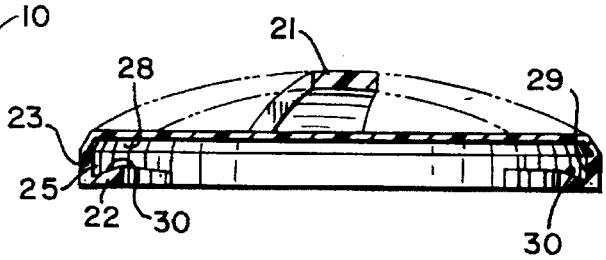
FIG. 10 is a horizontal section taken along line 10—10 of FIG. 3.
Figure 16:
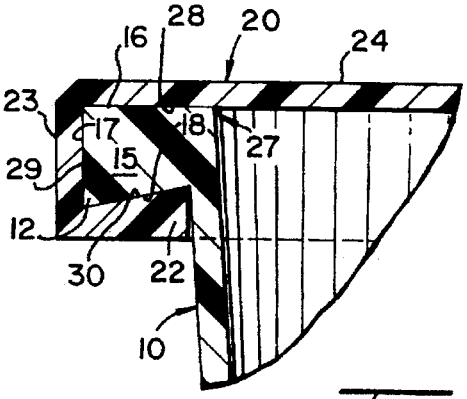
FIG. 16 is a sectional view of another embodiment of the present invention showing a modified structure.
Figure 3:
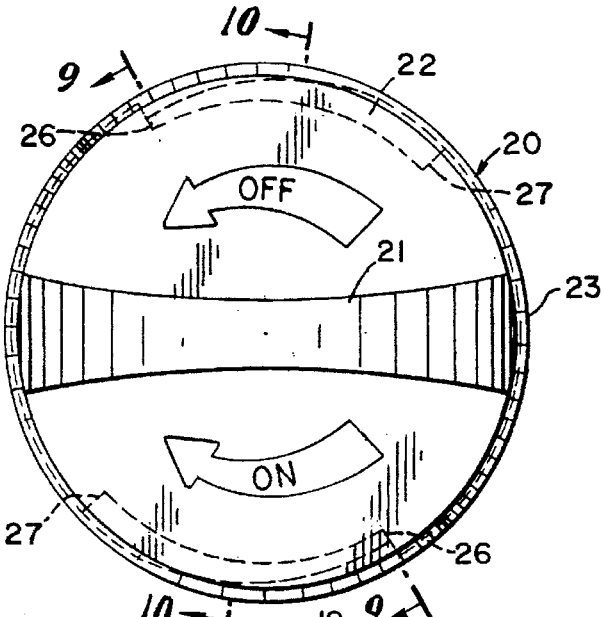
FIG. 3 is a top plan view of the lid of FIG. 2.
Figure 4:
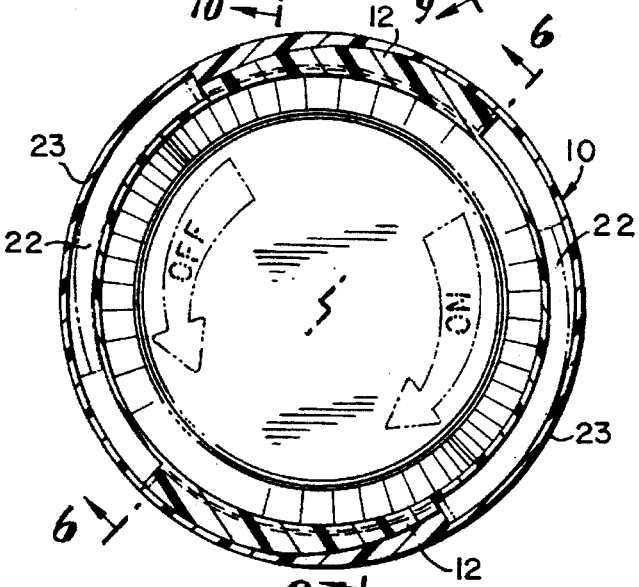
FIG. 4 is a top plan view, partly in section, of the lid of FIGS. 2 and 3 applied over the container of FIG. 1.
Figure 5:
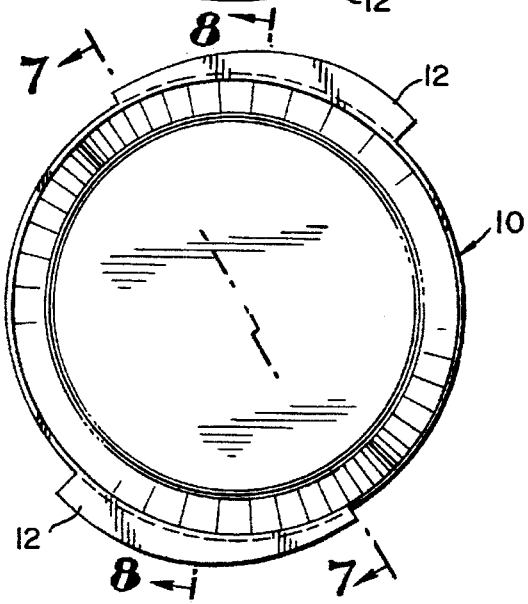
FIG. 5 is a top plan view of the container of FIG. 1.
Figure 6:
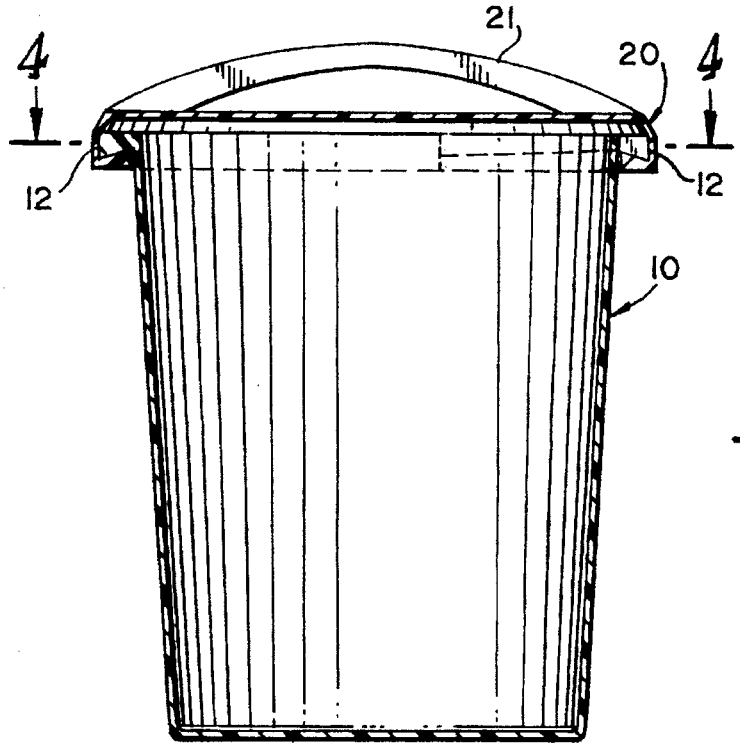
FIG. 6 is a vertical section taken along the line 6—6 of FIG. 4.
Figure 7:
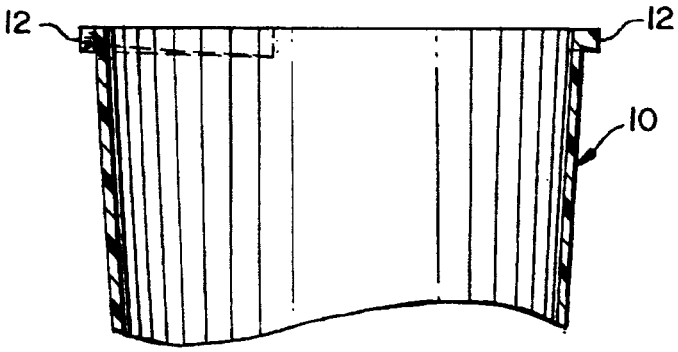
FIG. 7 is a partial vertical section along line 7—7 of FIG. 5.
Figure 8:
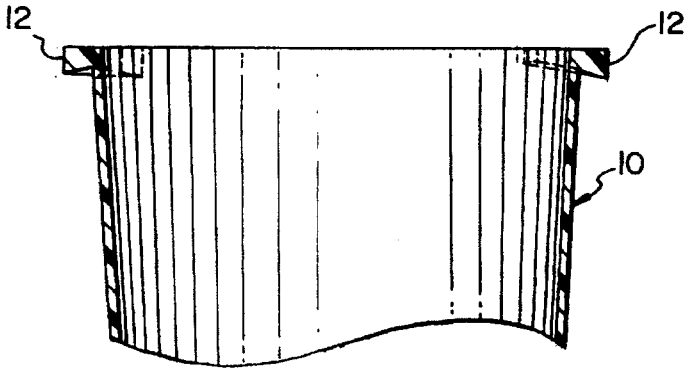
FIG. 8 is a partial vertical section along line 8—8 of FIG. 5.
Figure 11:
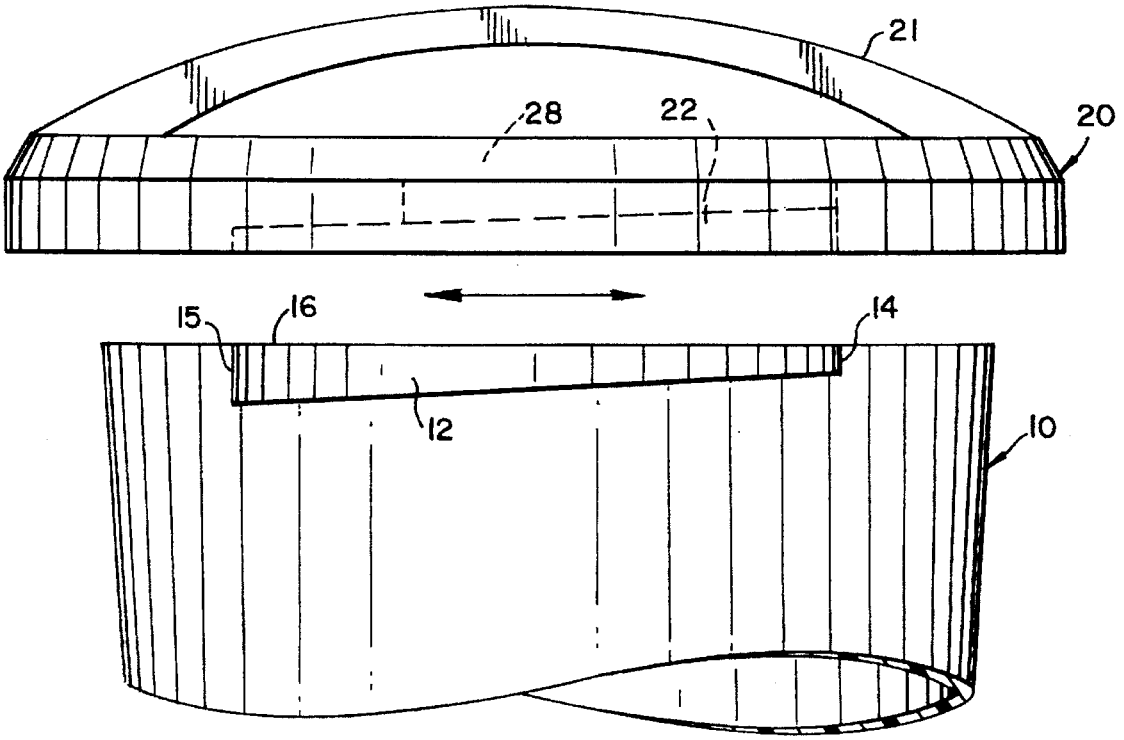
FIG. 11 is a front view of the lid of FIGS. 2 and 3 and a partial front view of the container, with the lid and container separated axially but showing the corresponding relationship of a rib and lug.

The embodiment of FIG. 16, is a similar arrangement of rib (15) and lug (22). The difference is in the construction and arrangement of cover (20) where inner roof surface (28) is flat and perpendicular to lid rim (23), whereas in FIGS. 2, 6, 9, 10, 11, 12, 13, 14, and 15, inner roof surface (28) is shown with an obliquely angled crown which meets rim (23) as a lid may be constructed and arranged for mass production. As described herein and as illustrated in FIG. 16, surfaces (16) and (28), surfaces (17) and (29) and surfaces (18) and (30) make frictional engagement when ribs (12) fully engage the lug members. In the prior aforementioned figures, the frictional engagement of surfaces (16) and (28) takes place as surface (28) rests on surface (16), such that surface (16) at the corner of rib surfaces (16) and (17) frictionally engages surface (28) where it meets rim (23).

The axial distances a and a' and radial distances b and b' shown in FIGS. 14 and 15 (not illustrated in FIG. 16) do not change from the two ends of lug (22). However, in order for passages (25) to taper, the designated distances shown in FIGS. 14 and 15 would change from the letters of FIG. 14 to the primed letters of FIG. 15 as follows: distance c decreases relative to distance c', and distances d, e, f, and g increase relative to distances d', e', f', and g' such that axial distance a equals axial distance a'
radial distance b equals radial distance b'
axial distance c is less than axial distance c'
axial distance d is greater than axial distance d'
axial distance e is greater than axial distance e'
radial distance f is greater than radial distance f'
oblique radial distance g is greater than oblique distance g'

Each passage (25) has an oblique floor (30) along a surface of lug (22) so that the cross-section of the passage is not square. The total thickness of the axial wall formed by lugs (22), lid rim (23) plus that of ribs (12) is sufficient to overcome any tendency for distortion when ribs (12) are aligned with lugs (22) of the lug members.

The cover plate or web (24) of the lid (20) is provided with directional arrows marked "ON" for clockwise rotation to tighten cover (20) onto container (10) and "OFF" for counter clockwise rotation to loosen the lid. When lid (20) is mounted in axial alignment over container (10) with lugs (22) resting in spaces (13), rotation of the cover in the "ON" direction enables the end of each lug defining a relatively large cross section end (27) of passage (25) to pass a relatively narrow end (14) of a corresponding locking rib (12) until the tapering reduction of the cross-section of each passage (25) cooperates with the tapering increase of the cross-section of each corresponding locking rib (12) to cause a tight fit between each locking rib (12) and its corresponding lug (22) that has increasing frictional force components in both the radial and axial directions. See FIGS. 11 and 12 which show such a locking relationship. As an optional feature, in order to secure a more permanent lock, each locking rib (12) may have one or more equally spaced indentations (112) that are engageable with a corresponding one or more spaced protrusions (122) at the counter-clockwise ends of said lugs (22) when the lid is fully locked onto container (10). The "ON" arrow provides a physical indication to what direction the lid is fully rotated and locked.

Axial locking between the locking ribs (12) and lugs (22) does not require that the locked elements, that is, ribs (12) and lugs (22), become distorted because the locked elements reinforce one another in both the radial direction and the axial direction of their circumferential overlap. In addition, each locking rib (12) has an upper rib surface (16) that extends horizontally when container (10) stands with its axis vertical so that a radially outer surface (17) of locking rib (12) extends parallel to the axis of container (10). A lower surface (18) of locking rib (12) extends radially inward in an obliquely upward direction.

The lug member has an inner roof surface (28) along the lower surface of web (24). Inner roof surface (28) is constructed and arranged to rest on upper rib surface (16) when lug (22) is rotated in a locking direction around locking rib (12). Lid rim (23) also has a radially inner lug surface (29) that moves along radially outer surface (17) of locking rib (12). Lug (22) is also provided with a radially inward extending member having an obliquely extending axially upward surface (30) that serves as a floor to the passage (25) through lug (22) that moves against lower surface (18) of rib (12).

The circumferential length of circumferential spaces (13) is slightly longer than the circumferential length of lugs (22) to enable the lugs (22) to be easily interposed between adjacent locking ribs (12) and then to rotate the lid relative to container (10) for an angle that need not exceed 90 degrees until locking ribs (12) enter the passage through lugs (22) until ribs (12) and lugs (22) reinforce one another when lid (20) locks to container (10).

In summary, this invention covers an improved pail and lid assembly comprising a container body having a longitudinal axis that is vertical when the container is standing and a lid constructed and arranged to be rotatably secured onto the container.

A plurality (not necessarily two) of external, wedge shaped locking ribs are integrally formed on the top portion of the container in circumferentially spaced relation thereround and a corresponding number (also not necessarily two) of wedge shaped lug members are arranged about the circumference of the lid. The ribs and lug members are constructed and arranged to be rotatably locked together.

Each locking rib (12) extends from a relatively thin and narrow rib end (14) to a relatively thick rib end (15) in a circumferential direction and also has a peripheral surface oriented substantially parallel to the longitudinal axis of the container. Each rib (12) has three external surfaces (16), (17) and (18) increasing in size and surface area from the thinner rib end (14) to thicker rib end (15). One of the external surfaces is an oblique surface (18) defining a wedge shape of rib (12).

Each of the lug members including a lug (22) defines a female wedge shaped passage (25) constructed and arranged to receive and engulf a corresponding rib (12). The lug members extend downward and inward from the circumference of the lid when the lid is oriented properly for application atop container (10).

In order to improve the tightness of the fit when the locking ribs engage the lug members, the lug members provide a passage (25) having lower surface (30), inclined upwardly and radially inwardly in substantially parallel relation to an oblique lower surface (18) of a corresponding rib (12) to increase the frictional force between the locking rib and the lug member. When lugs (22) engage locking ribs (12), three surfaces (28), (29) and (30) of each lug member make frictional engagement with three corresponding surfaces (16), (17) and (18) of each corresponding rib (12) to secure lid (20) to container (10) as shown in FIGS. 12, 14, 15 and 16. In other words, the FIG. 16 construction differs from that of the FIG. 14 embodiment in that a relatively wide area of surfaces (16) and (28) become engaged in FIG. 16, whereas in the FIG. 14 embodiment, the portion of surface (16) that engages surface (28) is adjacent the corner surface (16) formed with surface (17).

The passage (25) through each lug member is defined by a roof or horizontal upper surface (28) along the undersurface of cover plate or web (24), an outer axial surface (29) along the inner surface of lid rim (23), and lower radially extending obliquely oriented surface (30). Each passage is opened at its radially inner side to further facilitate relative movement of lugs (22) past ribs (12).

Figure 12:
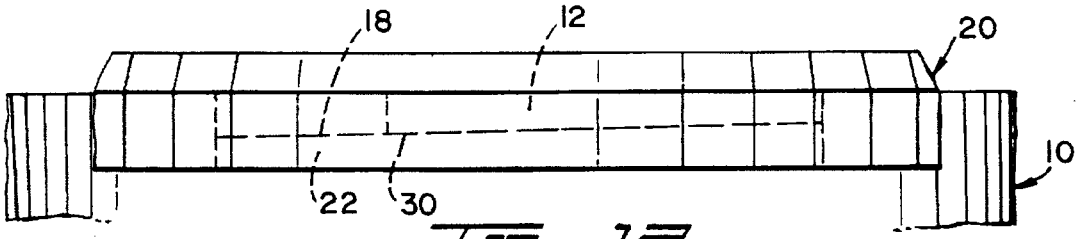
FIG. 12 is a sectional view of the container and lid of FIG. 11 with the rib and lug fully engaged.
Figure 13:
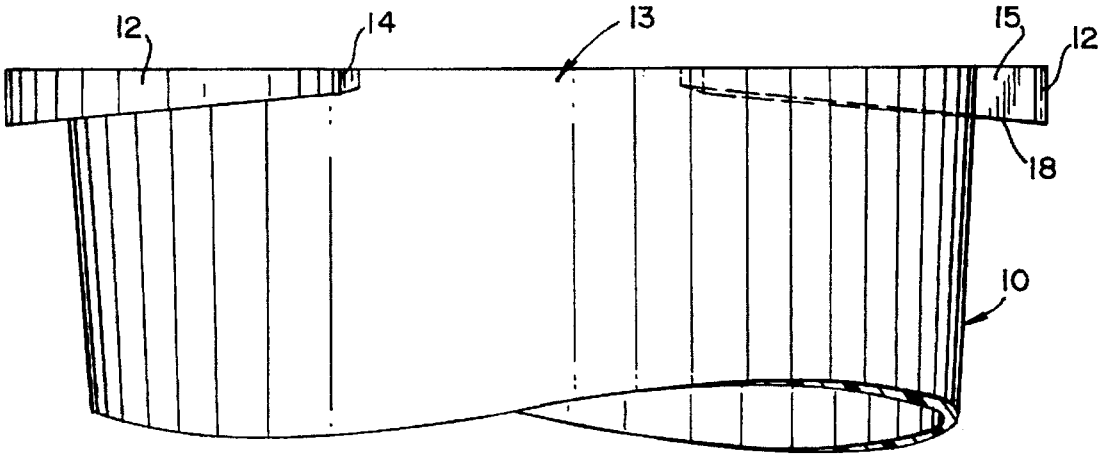
FIG. 13 is an enlarged sectional view of the lugs of the container.

Each locking rib (12) has art upper surface (16) that engages roof (28) of a corresponding lug member, each lid rim (23) has an inner axial surface (29) corresponding to outer axial surface (17) of rib (12), each lug (22) defines a floor along obliquely inwardly extending radial surface (30) that is engageable with the lower surface (18) of rib (12). When ribs (12) and lugs (22) are inter-engaged, outer surfaces (16), (17) and (18) of rib (12) and facing surfaces (28), (29) and (30) of the lug member engage and lid (20) is jammed on the container as shown in FIGS. 12, 14 and 15. This arrangement provides a maximum surface area of resistance (frictional fit) between lid and container. However, prior to jamming lid (20) clockwise onto container (10), small rib end (14) faces large passage opening (27) of passage (25) and outer surfaces (16), (17) and (18) do not yet jam against surfaces (28), (29) and (30) of the lug member at the start of the relative rotation that jams the ribs and the lugs together.

Figure 17:
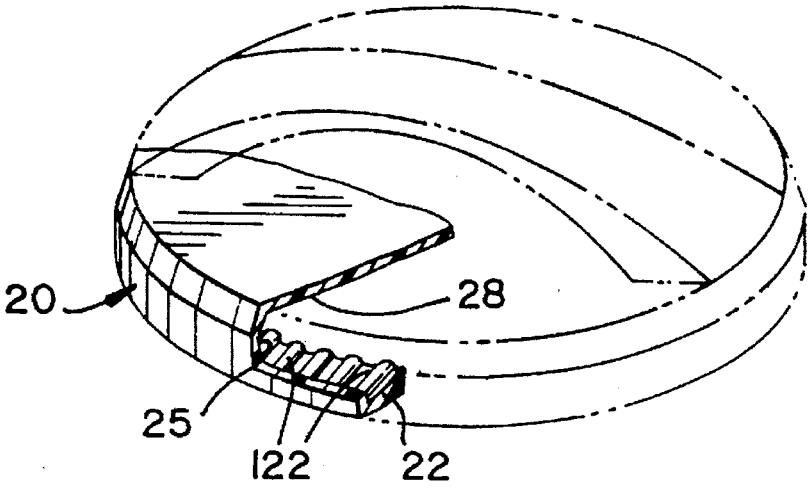
FIG. 17 is an enlarged perspective view of a lid showing a partial cross-section of one of its lugs having a plurality of spaced protrusions that engage a plurality of corresponding indentations along the end portion of a corresponding rib when the lid is fully locked onto the container.
Figure 18:
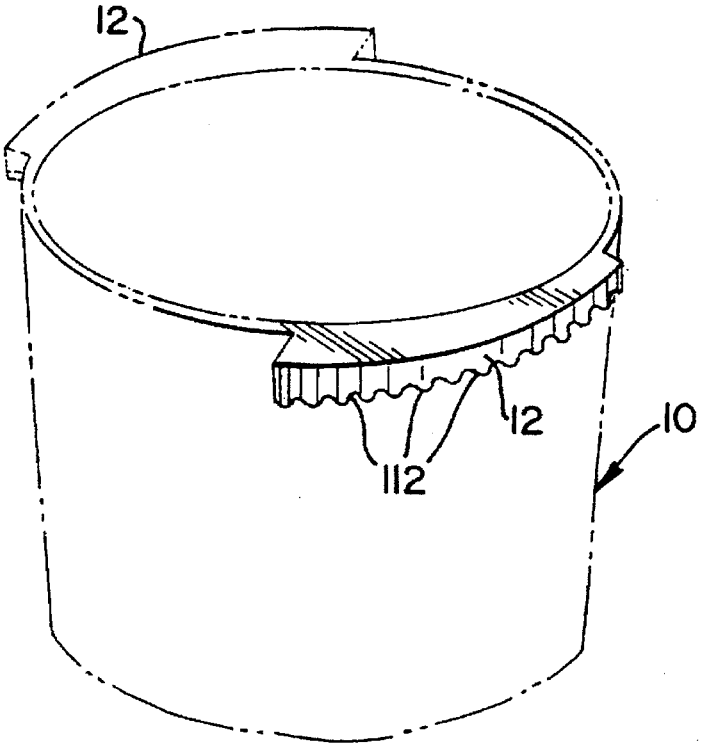
FIG. 18 is an enlarged perspective view of a portion of a container having corresponding ribs having indentations constructed and arranged to receive the plurality of protrusions illustrated in FIG. 17.

Optionally, in order to enhance full engagement and to prevent possible accidental loosening of lid (20), cooperating radially extending indentations (112), shown in FIG. 18, and radially extending protrusions (122), shown in FIG. 17 can be provided on the rib members and the lugs, respectively. While the illustrative embodiment suggests projections on the locking ribs cooperating with corresponding indentations on the lug members, it is also within the scope of this invention to apply indentations extending radially on the rib members and projections on the lug members.

In a specific embodiment of this invention, the cover has a horizontal web (24) of circular cross section and at least two diametrically opposed cover lugs (22) extending radially inward from circumferentially spaced peripheral portions of lid rim (23) which extends axially downward from web (24). The number of ribs (12) and lugs (22) may be any number exceeding two and preferably should be equal for ribs and lugs. However, the container can have more ribs than the cover has lugs or vice versa. For example, 6 or 4 ribs and 2 lugs may be provided.

In compliance with the Patent Statutes, Applicant has described and illustrated a preferred embodiment of this invention. It is understood, however, that many changes may be made without departing from the spirit of the present invention as defined by the claimed subject matter that follows.

What is claimed is:

1. In combination, a container and a lid having an essentially planar inwardly facing inner surface, said lid being constructed and arranged to be rotatably secured on said container, characterized by a plurality of ribs integrally formed to extend radially outward of an upper peripheral top portion of said container and circumferentially spaced around said top portion and tapering in cross section from a first rib end of relatively small cross section to a second rib end of relatively large cross section in a given circumferential direction, a plurality of lug members integrally formed about a circumference of said lid in circumferentially spaced relation, each lug member having a plurality of interior walls defining a wedge shaped passage tapering continuously in a given circumferential direction from a first lug end having a cross section larger than that of said first rib end to a second lug end where the cross-section of said passage is less than that of said second rib end so that there is clearance between said first lug end and said first rib end both axially and radially of said circumference that decreases upon continued rotation in a circumferential direction until said lug member and said ribs are jammed in surface-to-surface contact to reinforce one another, said circumferential spaces between adjacent of said ribs being sufficient to insert said lug members therebetween by relative axial movement prior to rotating said lid relative to said container, each of said ribs having a cross section that is constructed and arranged to permit relative rotation of said ribs and said lug members in a first circumferential direction between a position providing said clearance and a position providing said jamming, wherein said ribs have at least three exterior walls that simultaneously engage at least three corresponding interior walls of corresponding of said passages in surface-to-surface contact when said ribs and said corresponding passages simultaneously engage each other, said inwardly facing surface of said lid being at least part of one of said three interior walls of each of said corresponding passages.

2. The combination according to claim 1, wherein said essentially planar inwardly facing inner surface has an obliquely angled crown which meets a rim of said lid.

3. In combination, a container and a lid having an essentially planar inwardly facing inner surface constructed and arranged to be rotatably secured on said container, characterized by a plurality of ribs having at least three outwardly facing walls integrally formed to extend radially outwardly of an upper peripheral top portion of said container and circumferentially spaced around said top portion and tapering in cross section from a first rib end of relatively small cross section to a second rib end of relatively large cross section in a given circumferential direction, a plurality of lug members integrally formed about a circumference of said lid in circumferentially spaced relation, each lug member defining a wedge shaped passage having inwardly facing walls corresponding to said at least three outwardly facing walls of a corresponding rib tapering continuously in a given circumferential direction from a first lug end having a cross section larger than that of said first rib end to a second lug end where the cross-section of said passage is less than that of said second rib end so that there is clearance between said first lug end and said first rib end both axially and radially of said circumference that decreases upon continued rotation in a circumferential direction until said lug members and said ribs are jammed in surface-to-surface contact to reinforce one another, said circumferential spaces between adjacent of said ribs being sufficient to insert said lug members therebetween by relative axial movement prior to rotating said lid relative to said container, each of said ribs having a wedge shaped cross section that is constructed and arranged to permit relative rotation of said ribs and said lug members in a first circumferential direction between a position providing said clearance and a position providing said jamming, wherein said at least three outwardly facing walls of said ribs simultaneously engage three corresponding inwardly facing walls of a said corresponding passage when said ribs and said lugs simultaneously engage in surface-to-surface contact, said inner surface of said lid forming at least part of one of said three corresponding inwardly facing walls of said passages and at least one of said three inwardly facing walls extends in an oblique plane.

4. The combination as set forth in claim 3, further including cooperating protrusions and indentations supported on said rib members and said lug members in positions to engage one another and to establish a bar to further relative rotational movement in a circumferential direction when said lugs and said ribs are in relative positions where they fit sufficiently tightly to jam.

5. The combination as set forth in claim 4, wherein said protrusions extend radially of said lugs and said indentations extend radially of said locking ribs in positions where said protrusions from said lugs engage said indentations into said ribs.

6. The combination as set forth in claim 3, wherein said lug members and said rib members are constructed and arranged to make said tight fit after a circumferential rotation not exceeding 90 degrees after said first lug end passes said first rib end.

7. The combination according to claim 3, wherein each of said ribs has an upper radial wall, an outer axial wall and a lower oblique radial wall defining a peripheral rib surface, and said wedge shaped passage defined by each of said lug members has an upper radial surface defining a roof, a peripheral inwardly facing surface defining an axial wall, and an oblique lower surface extending radially inward from said axial wall to define an oblique floor for said passage, said ribs and said lug members being so constructed and arranged that there is clearance between the narrow end of each said rib and the wide end of its corresponding passage, which clearance diminishes gradually when there is relative rotational movement between said ribs and said lug members to cause said three walls of said rib members to engage simultaneously said three surfaces of said passage and frictional fit sufficiently tight for said lug members to cooperate with said rib members in surface-to-surface contact to improve the tightness of said fit.

8. A container having a rotatable cover constructed and arranged to be rotatably locked onto said container, said cover having a horizontal web of circular cross-section having an inwardly facing inner surface, a given periphery and at least two diametrically opposed cover lugs extending downward from circumferentially spaced peripheral portions of said web, said web defining a roof for said cover lugs, an axial wall extending downward from one or the other of said circumferentially spaced peripheral portions of said web and a lower radial wall extending generally radially and obliquely inwardly from said one or other of said axial walls associated therewith, said cover lugs being constructed and arranged to define a pair of passages of tapering cross section extending from a relatively wide lug end to a relatively narrow lug end in a given circumferential direction, each of said passages having a circumferentially extending, radially inwardly facing opening between said web and said lower radial wall defining an oblique floor for said passages, said container having a pair of circumferentially spaced, diametrically opposed ribs extending circumferentially around the top of said container and spaced circumferentially from one another sufficient distance to enable said cover to be applied over said container with said cover lugs disposed between said circumferentially spaced ribs, each of said circumferentially extending ribs tapering in cross section in said given circumferential direction from a rib end of relatively small cross section to a rib end of relatively large cross section when said cover is mounted on said container, each rib comprising an upper radial rib wall, an outer axial rib wall and an inner oblique rib wall, each of said circumferentially extending ribs having its smaller cross section end sufficiently smaller than the relatively wide end of said cover lugs to enable said cover lug to pass over said relatively small cross section rib end until said cover lugs fit snugly in direct surface-to-surface contact against said ribs on all three of said rib walls when said cover is rotated relative to said container.

9. A container as in claim 8, wherein said cover lugs are constructed and arranged to define a pair of passages of tapering cross section extending from a relatively wide lug end to a relatively narrow lug end in a given circumferential direction less than 90 degrees circumferentially.

10. A container as in claim 8, wherein said relatively wide lug end of one of said cover lugs is diametrically opposed to said wide lug end of said other cover lug, said relatively narrow lug end of said one cover lug is diametrically opposed to the relatively narrow lug end of said other cover lug, said relatively narrow rib ends of said ribs are diametrically opposed to one another and said relatively wide rib ends of said ribs are diametrically opposed to one another.

11. A container as in claim 8, wherein said lugs are constructed and arranged to have their relatively narrow ends oriented in one circumferential direction from their relatively wide ends and said ribs are constructed and arranged to be oriented with their narrow ends oriented in a circumferential direction opposite from said one circumferential direction from their relatively wide ends.

* * * * *